United States Patent [19]

Bryson

[11] 4,070,274

[45] Jan. 24, 1978

[54] COARSE CONCENTRATED IRON ORE FOR CATALYTIC PURPOSES

[75] Inventor: Roy E. Bryson, Port Cartier, Canada

[73] Assignee: United States Steel Corporation, Pittsburgh, Pa.

[21] Appl. No.: 665,846

[22] Filed: Mar. 11, 1976

[51] Int. Cl.[2] ..... B03B 7/00

[52] U.S. Cl. ..... 209/10; 209/17; 209/211

[58] Field of Search ..... 209/10, 13, 17, 18, 209/211, 5, 459, 434, 3; 241/20, 24

[56] References Cited

U.S. PATENT DOCUMENTS

| | | | |
|---|---|---|---|
| 2,514,958 | 7/1950 | Lee | 209/18 |
| 2,585,719 | 2/1952 | Alvord | 209/250 X |
| 3,323,646 | 6/1967 | Humphreys | 209/211 |
| 3,372,803 | 3/1968 | DeLisle et al. | 209/5 |
| 3,640,383 | 2/1972 | Wantling | 209/17 |

OTHER PUBLICATIONS

Thompson et al., "The Humphreys Spiral", *Engineering and Mining Journal,* vol. 151, No. 8, Aug. 1950, pp. 87–89.

*Primary Examiner*—Frank W. Lutter
*Assistant Examiner*—Ralph J. Hill
*Attorney, Agent, or Firm*—William L. Krayer

[57] ABSTRACT

An iron ore concentrate is made having at least 60% −6 to +14 mesh and no more than about 1% −20 mesh, by a process preferably employing a small counterflow sizer on a product obtained from the concentrate of a spiral concentrator through which is processed a high-iron mill product or partially concentrated coarse feed. The product of the counterflow sizer is agitated to separate cohering particles and then further concentrated.

11 Claims, 5 Drawing Figures

COARSE CONCENTRATED IRON ORE FOR CATALYTIC PURPOSES

BACKGROUND OF THE INVENTION

Prior to the present invention it has been very difficult to prepare coarse concentrated hematite for use in catalytic and similar processes, because of the tendency to obtain in the coarse concentrate too high a percentage of fines, that is, more than about 1% −20 mesh. It is known that iron oxide catalysts and/or absorbents containing too high a concentration of fines will tend to interfere with the chemical processes to be treated or catalyzed, and the fines tend to be carried into the process stream. An economic method for preparing a coarse, low fines product has not been known prior to the present invention.

SUMMARY OF THE INVENTION

I have found that if a coarse high-iron mill product or concentrate feed is fed through a particular series of concentrators and separators, a satisfactory, and, importantly, very consistent product can be made.

My invention will be explained in more detail with reference to the attached drawings.

Figure 1:
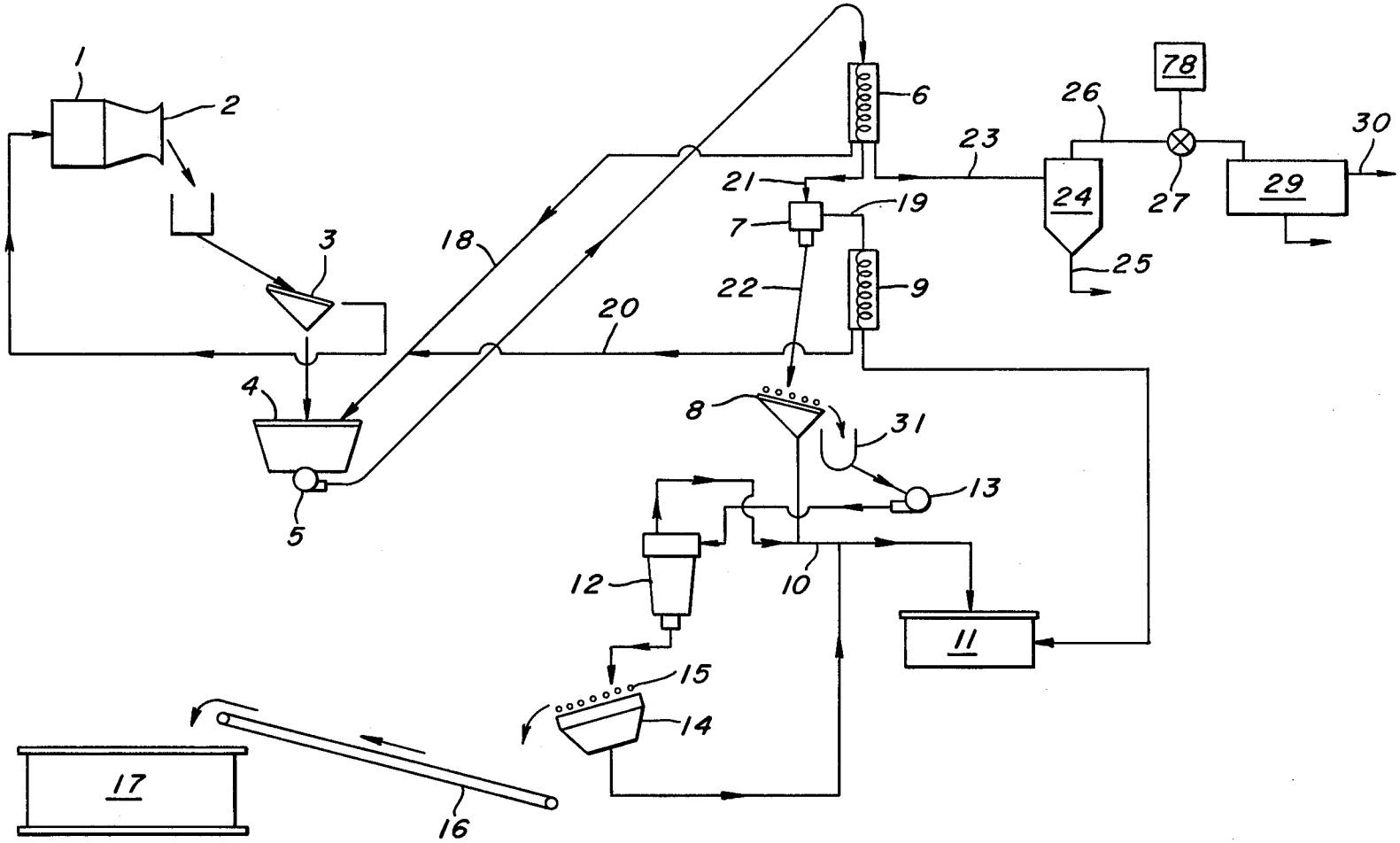

FIG. 1 is a more or less diagrammatic depiction of the invention, showing the flow of material from the grinding stage to the product stage.

Figure 2:
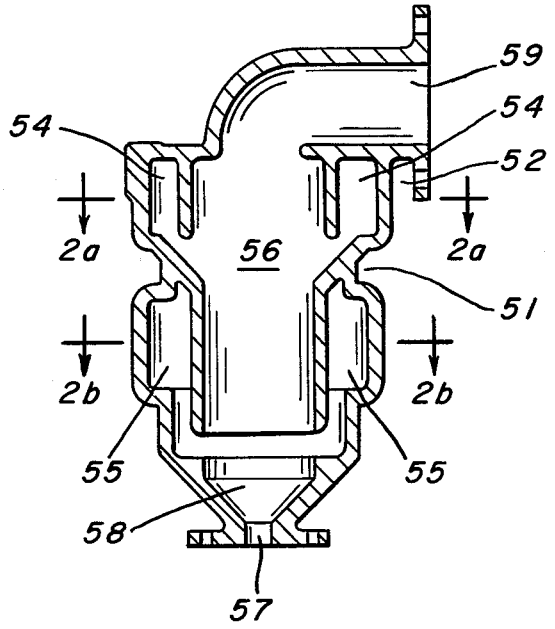
Figure 2A:
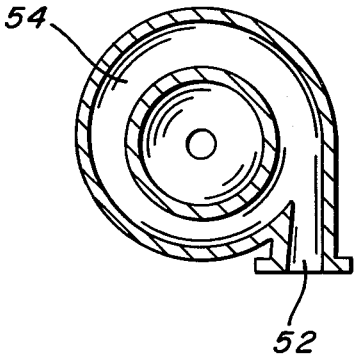
Figure 2B:
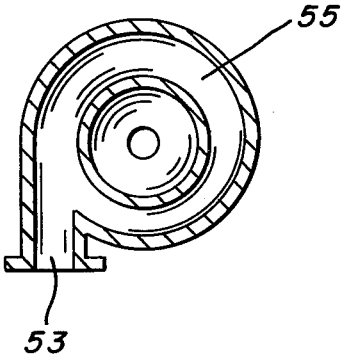
Figure 3:
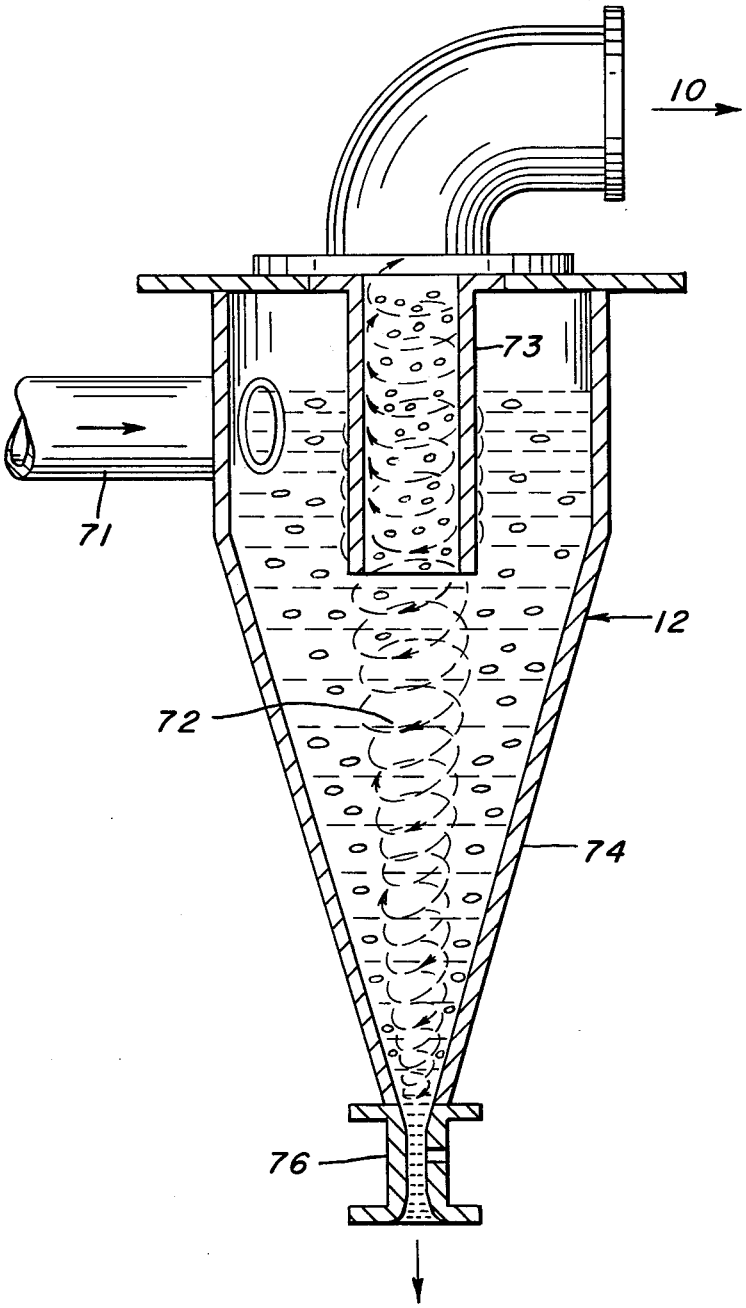

FIGS. 2, 2*a*, and 2*b* are sectional views of a hydraulic counterflow sizer used in the invention, and FIG. 3 is a sectional view of a preferred dewatering high-velocity cyclone.

Referring to FIG. 1, a conventional mill 1 is shown having a mill discharge 2, and a line directing the discharge to a 3 -millimeter screen 3. Material passing through the screen 3 is sent to a retainer 4 and then to a pump 5 and pumped at a constant rate to a distributor not shown for distribution to rougher spirals 6, of which there may be several in parallel. To make the low-fine product, concentrate from the rougher spiral 6 is sent through line 21 to a pocket sizer 7 and the concentrate therefrom is sent through line 22 to a spray bar unit screen 8. Screen 8 may be vibrated, preferably at a rate greater than 1800 vibrations per minute. Tailings from the initial rougher spiral 6 are discarded, but the water in line 23 handling the tailings may be sent to a cyclone 24 to remove relatively large sizes through line 25; the overflow is passed in line 26 through coagulant addition point 27 containing coagulant from source 78, to thickner 29. where flocculated solids are settled out and the water recycled through line 30. As is known in the art, the coagulant may be inorganic, such as alum, and/or include floc-forming polymers such as guar gum or polyacrylamide. Middlings from rougher spiral 6 are recycled through line 18 to rougher spiral feed pump 5. Cleaner spiral feed for cleaner spiral 9 is obtained through line 19 from the overflow of pocket sizer 7. Concentrate from spiral 9 is sent to filter 11. Middlings from cleaner spiral 9 is also recycled to pump 5 through lines 18 and 20. Material passing through the screen 8 is sent to line 10 and carried to filter 11. Material overflowing the screen 8 is fed into cyclone 12 by way of pump 13. The overflow, i.e., relatively large particles from screen 8 are placed in container 31, which may also serve for the addition of water. Pump 13 creates agitation and turbulence which serves to break up and separate cohering particles. In cyclone 12, a separation of these coarse and fine particles is completed, the coarse particles being delivered to screen 14 which is located underneath spray bars 15. Materials overflowing the spray bars passes onto conveyor 16 for delivery to a production bin 17. Material passing through screen 14 is sent to filter 11.

Typical screen analyses at various key points throughout the illustration are as follows:

The feed to rougher spiral 6 is typically a ground hematite of the following size:

| U.S. Mesh Size | % by Weight | Running Total, % by Weight |
|---|---|---|
| 8 | 0.4 | 0.4 |
| 10 | 4.4 | 4.8 |
| 14 | 10.9 | 15.7 |
| 20 | 14.1 | 29.8 |
| 28 | 18.9 | 48.7 |
| 35 | 16.8 | 65.5 |
| 48 | 12.4 | 77.9 |
| 65 | 7.4 | 85.3 |
| 100 | 5.3 | 90.6 |
| 150 | 3.1 | 93.7 |
| 200 | 1.9 | 95.6 |
| −200 | 4.4 | 100.0 |

The concentrate from spiral concentrator 6 (line 21) will contain about 10 to 25% in the range of −6 to +14 mesh and about 75% to 90% −20 mesh. The concentrate from sizer 7 (line 22) will typically contain about 15 to about 40% particles in the range of −6 to +14 mesh, and about 60 to about 85% −20 mesh. The concentrate leaving cyclone 12 and passing to screen 15 contains typically about 50 to about 98% particles in the range of −6 to +14 mesh and no more than about 10% −20 mesh. The oversize product leaving screen 15 for conveyor 16 has about 60 to about 99.9% −6 to +14 mesh and no more than about 1% −20 mesh.

The rougher spiral 6 is a typical commercial spiral having a drop of 13 to 18 inches in a 360° turn, and a vertical concentrate collector pipe; it is adapted to accommodate a typical flow of about 32 gallons of water per minute, or any flow from about 20 to about 50 gallons per minute. Approximately 50% of the solids typically emitted by the rougher spiral are tailings disposed of through line 23.

The pocket sizer 7 is preferably a Humphreys counterflow sizer of the type described in the transactions of the 29th annual University of Minnesota Mining Symposium, Jan. 17, 1968. It is further described in FIGS. 2, 2*a*, and 2*b*.

Referring now to FIGS. 2, 2*a* and 2*b*, the hydraulic counterflow sizer has a generally cylindrical body 51 which includes openings 52 and 53 leading to the channels 54 and 55 respectively for the introduction of a first coarse concentrate and water, respectively. The coarse concentrate from channel 54 forms a vortex in the upper portion of chamber 56, where the relatively fine solids become dispersed into the upwardly swirling water from channel 55, which swirls in a direction opposite to that of the first coarse concentrate. The relatively heavy solids are centrifugally moved outwardly toward the wall 57 of chamber 56 and tend to fall through bottom outlet 57 at the inverted apex of a generally conical configuration 58. Outlet 57 may be adjustable in diameter. The flow of water in channel 55 may also be adjusted to affect the velocity of upwardly rising water; as the velocity is increased, a greater portion of the larger, denser, and/or more irregularly shaped particles will be carried out through overflow exit 59. The concentrate in channel 54 is introduced under a constant pressure or head of about 28–34 or more inches, preferably adjusted at 30–32 inches. The water pressure or head in channel 55 should be slightly higher in any event than the concentrate; i.e., if the concentrate is at 38 inches, the water should be at least 40. Generally, a high specific gravity concentrate requires a greater difference in head than a low specific gravity concentrate. The difference in head should generally be in the range of from about 1 to 6 inches.

FIG. 3 is a side sectional view of a commercial hydrocyclone 12 which may be used for dewatering and separating the screened overflow from pump 13. Feed from pump 13 enters the hydrocyclone 12 through port 71 tangentially to the wall of the upper cylindrical portion of the unit, where it immediately enters into the formulation of a vortex 72 which forms between distending neck 73 and terminus 76 at the lower end of the conical base 74.

Thus, it may be seen that my invention includes apparatus for making a low fines iron ore concentrate, which may comprise a spiral concentrator, a hydraulic counterflow sizer for size-separating the concentrate therefrom, means for screening the concentrate from said sizer, agitating means for subjecting the overflow from said screening means to turbulence to separate cohering particles in said overflow, and means for concentrating the product of said agitating means. My invention also includes a process for making a coarse, low-fines iron ore concentrate comprising concentrating a ground iron ore to obtain a first coarse concentrate having about 10 to about 25% by weight particles of −6 to +14 mesh and about 75% to about 90% −20 mesh, hydraulically sizing said first coarse concentrate to obtain a second coarse concentrate having about 15 to about 40% particles of −6 to +14 mesh and about 60% to about 85% −20 mesh, agitating at least a portion of said second coarse concentrate to separate cohering particles, to obtain a third coarse concentrate, and concentrating said third coarse concentrate to obtain a product containing at least 60% particles in the range of about −6 to +14 mesh and up to about 1% −20 mesh.

Of particular note is the fact that all material which passes through screens 14 and 8 is removed completely from the cycle.

My invention is not limited to the above particular disclosure and configuration. It may be otherwise varied within the scope of the following claims.

I claim:

1. Process for making a coarse, low-fines iron ore concentrate comprising a. concentrating, by gravity and density in a spiral concentrator, a ground and screened iron ore to obtain tailings and a first coarse concentrate having about 10 to about 25% by weight particles of −6 to +14 mesh and about 75 to about 90% −20 mesh, b. hydraulically sizing said first coarse concentrate to obtain a second coarse concentrate having about 15 to about 40% particles of −6 to +14 mesh and about 60 to about 85% −20 mesh, c. agitating at least a portion of said second coarse concentrate to separate cohering particles, to obtain a third coarse concentrate, and d. size-separating said third coarse concentrate to obtain a product containing at least 60% particles in the range of about −6 to +14 mesh and up to about 1% −20 mesh.

2. Process of claim 1 in which the ground iron ore is about 20 to about 35% ground iron ore in water.

3. Process of claim 1 in which tailings from step (a) are treated to remove fines therefrom and the water remaining from said tailings is recycled.

4. Process of claim 3 in which the tailings are treated with a coagulant to assist in the settling of the fines, and the fines are removed from the water after settling.

5. Process of claim 1 in which the second coarse concentrate is screened and only the screen oversize is agitated to form the third coarse concentrate.

6. Process of claim 5 in which water is added to the screen oversize.

7. Process of claim 5 in which the second coarse concentrate is screened with a screen vibrating at a frequency of at least about 1800 vibrations per minute.

8. Apparatus for making a coarse, low-fines iron ore concentrate comprising a. a spiral concentrator, b. a hydraulic counterflow sizer for size-separating the coarse concentrate therefrom, c. means for screening the coarse concentrate from said sizer, d. agitating means for subjecting the overflow from said screening means to turbulence to separate cohering particles in said overflow, and e. means for size-separating the product of said agitating means.

9. Apparatus of claim 8 including means for removing fines from the overflow of said counterflow sizer by settling.

10. Apparatus of claim 8 in which the means for screening is a high-frequency vibrating screen.

11. Apparatus of claim 10 in which the screen is capable of vibrating at more than 1800 vibrations per minute.

* * * * *